US008541354B2

(12) United States Patent
Brooker et al.

(10) Patent No.: US 8,541,354 B2
(45) Date of Patent: Sep. 24, 2013

(54) CATALYTIC LAUNDRY DETERGENT COMPOSITION COMPRISING RELATIVELY LOW LEVELS OF WATER-SOLUBLE ELECTROLYTE

(75) Inventors: Alan Thomas Brooker, Newcastle upon Tyne (GB); Nigel Patrick Somerville Roberts, Newcastle upon Tyne (GB); Gregory Scot Miracle, Hamilton, OH (US); Neil Joseph Lant, Newcastle upon Tyne (GB); Philip Frank Souter, Northumberland (GB); Mark Forrest, Northumberland (GB); Colin Ure, Tyne and Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/888,495

(22) Filed: Sep. 23, 2010

(65) Prior Publication Data

US 2011/0015109 A1 Jan. 20, 2011

Related U.S. Application Data

(63) Continuation of application No. PCT/US2010/041020, filed on Jul. 6, 2010.

(60) Provisional application No. 61/325,403, filed on Apr. 19, 2010, provisional application No. 61/224,153, filed on Jul. 9, 2009.

(51) Int. Cl.

| | |
|---|---|
| ***C11D 3/06*** | (2006.01) |
| ***C11D 3/10*** | (2006.01) |
| ***C11D 3/386*** | (2006.01) |
| ***C11D 7/42*** | (2006.01) |

(52) U.S. Cl.

USPC ..... 510/320; 510/276; 510/300; 510/392; 510/445; 510/446; 8/137

(58) Field of Classification Search

USPC ..... 510/341, 357, 392, 300, 320, 530, 510/276, 445, 446; 8/137

See application file for complete search history.

(56) References Cited

U.S. PATENT DOCUMENTS

| | | | | |
|---|---|---|---|---|
| 4,438,024 | A * | 3/1984 | DelGreco et al. | 510/341 |
| 6,583,096 | B1 * | 6/2003 | Kott et al. | 510/357 |
| 2006/0189501 | A1 * | 8/2006 | Lant et al. | 510/392 |
| 2011/0005003 | A1 | 1/2011 | Dykstra et al. | |

FOREIGN PATENT DOCUMENTS

| | | | |
|---|---|---|---|
| WO | WO 2004/074419 | * | 9/2004 |
| WO | WO2004/074419 | A2 | 9/2004 |
| WO | WO2005/040286 | A1 | 5/2005 |
| WO | WO2011/005913 | A1 | 1/2011 |

OTHER PUBLICATIONS

Park "Quantitative Analysis of the Effect of Salt COncentration on Enzymatic Catalysis" J Am. Chem SOc. 2001, V 123, 11472-11479.*

Baudin, P., Renoncourt A., Touraud D., Kunz W., Ninham B.W.—"Hofmeister Effort on Enzymatic Catalysis and Colloidal Structures"—Current Opinion in Colloid and Interface Science, vol. 9, 2004, pp. 43-47, XP002606146.

Park C., Raines R.T.—"Quantitative Analysis of the Effect of Salt Concentration on Enzymatic Catalysis"—J. Am. Chem. Soc., vol. 123, Oct. 30, 2001, pp. 11472-11479, XP002606147.

"Rethinking Detergent Formulations" by P. Skagerlind, S. Friis-Jensen, M.G. Lauesgaard Proceedings of the 55th Sepawa Congress and European Detergents Conference, Wurzburg, Bayern, Germany, 2008, p. 103-106.

"A Cleaner, Greener Future at No Extra Costs" by P.H. Nielsen and P. Skagerlind Jahrbuch für den Praktiker 2009: Produkte, Rohstoffe und Formulierungen für Haushalt, Gewerbe und Industrie, ed. Robert Fischer (ISBN 978-3-87846-270-5).

"Sustainable Innovation" by P.H. Nielsen and Peter Skagerlind, Cost-Neutral Replacement of Surfactants With Enzymes, Household and Personal Care Today, Apr. 2007, p. 3-7.

"Putting a Green Foot Forward in the Pursuit of Sustainable Washing" by Frederic Issenhuth, Guillaume Trepo, Sandra Friis-Jensen and Tom Branna, Detergents, Troubling Times, Happi, Aug. 2008, p. 4-5.

"Go Green with Cost-Efficient Bio-Based Technology" by Dr. Teresa Neal, Happi, Jan. 2009, p. 87-88.

"Sustainable Innovation" by Peter Skagerlind, Sandra Friis-Jensen and Michael Carlsson Lauesgaard, More Sustainable Detergents Through Reformulation, Household and Personal Care Today, Apr. 2008, p. 38-40.

"Detergents Maximize Their Fighting Power with Enzymes" by Thomas Hessellund and Yuan Yuan Zhao, Soaps, Detergents & Toiletries Review, May 2008, p. 25-26.

J. Oakes, S. Dixon: "Adsorption of dyes to cotton and inhibition by polymers", Coloration Technology, vol. 119, 2003, pp. 140-149, XP002669084.

International Search Report dated Mar. 5, 2012 containing 9 pages.

* cited by examiner

*Primary Examiner* — Lorna M Douyon
*Assistant Examiner* — Amina Khan
(74) *Attorney, Agent, or Firm* — Tiffany M Zerby

(57) ABSTRACT

A solid laundry detergent composition having multiple catalysts and water-soluble electrolyte, wherein the ratio of (i) the total reduction in activation energy in kilojoules per mole achieved by the catalysts to (ii) the electrolytic strength of the laundry detergent composition at a concentration of 1 g/l in de-ionized water and at a temperature of 25° C. in $mScm^{-1}$ laundry detergent composition is at least 300.

5 Claims, No Drawings

CATALYTIC LAUNDRY DETERGENT COMPOSITION COMPRISING RELATIVELY LOW LEVELS OF WATER-SOLUBLE ELECTROLYTE

CROSS REFERENCE TO RELATED APPLICATION(S)

This application is a Continuation of International Application No. PCT/US2010/041020, filed Jul. 6, 2010, which claims the benefit of U.S. Provisional Application No. 61/325,403, filed Apr. 19, 2010; and U.S. Provisional Application No. 61/224,153, filed Jul. 9, 2009.

FIELD OF THE INVENTION

The solid laundry detergent compositions of the present invention are highly catalytic, and comprise relatively low levels of water-soluble electrolytes. These solid detergent compositions exhibit excellent cleaning performance, show improved catalytic deposition on the fabric, and also show improved rinsing profiles. The solid detergent compositions also have extremely good environmental profiles.

BACKGROUND OF THE INVENTION

Laundry detergent manufactures continually seek to improve the performance of their solid products, whilst at the same time improve their environmental profile. Catalysts, such as enzymes and/or bleach catalysts have been used to improve the performance of the detergent product In addition, recent trends in improving the environmental and sustainability profile of the laundering process have reduced the amount of water being used during the laundering process. For example, consumer demand is increasing for automatic washing machines that use less water, use less rinsing steps, and have improved environmental profiles.

Catalytic laundry detergent compositions are known, such as WO2004/074419, which alleges that enzymes can be used to partly or fully replace detergent components such as surfactants, builders, polymers and bleaches and still provide superior cleaning. It is also of course common general knowledge that catalysts lower the activation energy of the reactions they catalyse. However, there is very little understanding about the activation energy reduction achieved by catalysts in a laundry detergent context, and there is little understanding or appreciation about how one must control the catalytic capability of a laundry detergent composition relative to other ingredients present in the detergent matrix.

Turning back to the trends of lower water usage during the laundering process, it becomes even more critical that the catalytic capability of a solid laundry detergent composition is understood and controlled. For example, smaller wash liquors mean higher concentration of active laundry detergent ingredients in the wash, which in turn means increased competition for fabric surface deposition. In addition, less water during the rinsing steps, and fewer rinsing steps, places greater stress on rinsing these laundry detergent ingredients from the fabric during the rinsing stage of the laundering process.

The inventors have found that controlling the catalytic capability of the solid laundry detergent composition relative to the electrolytic strength of the laundry detergent composition leads to improved fabric surface deposition of the catalysts, and an improved rinsing profile of the laundry detergent composition.

The inventors have found that reducing the electrolytic strength of the solid laundry detergent composition relative to the increasing its catalytic capability provides a solid laundry detergent composition having improved cleaning performance and improved rinsing profile.

SUMMARY OF THE INVENTION

The present invention relates to a solid laundry detergent composition defined by claim 1.

DETAILED DESCRIPTION OF THE INVENTION

Laundry Detergent Composition

The solid laundry detergent composition comprises multiple catalysts (i.e. more than one), preferably at least three, or at least four, or at least five, or at least six, or at least seven, or at least eight, or at least nine, or at least ten, or at least eleven, or even at least twelve catalysts. The catalysts are defined in more detail below.

The catalytic capability of the solid laundry detergent composition is controlled relative to the electrolytic strength of the laundry detergent composition such that the ratio of (i) the total reduction in activation energy in kilojoules per mole achieved by the catalysts to (ii) the electrolytic strength of the laundry detergent composition at a concentration of 1 g/l in de-ionized water and at a temperature of 25° C. in $mScm^{-1}$ laundry detergent composition is at least 30, preferably at least 40, or at least 50, or at least 60, or at least 70, or at least 80, or at least 90, or at least 100, or at least 120, or at least140, or at least 160, or at least 180, or even at least 200.

The methods for determining the reduction in activation energy achieved by the catalysts, and the electrolytic strength of the laundry detergent composition are described in more detail below.

The composition can be in any suitable solid form, such as free-flowing particulate form, or unit dose form including pouch, tablet, sheet, or any combination thereof. Preferred forms include detergent sheets, detergent pouches including single and multi-compartment pouches, detergent powders including agglomerates, spray-dried powder, prills, extrudates, flakes, noodles, needles and any combination thereof.

Preferably, the composition is in free-flowing particulate form, for example such that the composition is in the form of separate discrete particles.

The composition is a fully finished laundry detergent composition. Typically, if the composition is in free-flowing particulate form, the composition comprises a plurality of chemically different particles populations. The composition is not just a component of a laundry detergent composition that can be incorporated into a laundry detergent composition (such as an enzyme prill, or a surfactant particle, or a bleach particle), it is a fully finished laundry detergent composition. That said, it is within the scope of the present invention for an additional rinse additive composition (e.g. fabric conditioner or enhancer), or a main wash additive composition (e.g. bleach additive) to also be used in combination with the laundry detergent composition during the method of the present invention. Although, it may be preferred for no bleach additive composition is used in combination with the laundry detergent composition during the method of the present invention.

It is highly preferred to reduce the electrolytic strength of the laundry detergent composition, however care must be taken that the electrolytes one removes from, or reduces the level of in, the composition do not significantly impair the performance of the composition. It is highly preferred to remove electrolytes such as sodium sulphate and/or sodium chloride compared to removing ionic surfactant electrolytes. However, if the electrolytic strength of the composition needs to be reduced further, then the level of ionic surfactants can of course be lowered, or the ionic surfactants can be removed from the formulation.

Preferably, the composition comprises from 0 wt % to 10 wt %, preferably to 8 wt %, or to 6 wt % or to 2 wt % sodium sulphate. The composition may even be substantially free of sodium sulphate. Substantially free means comprises no deliberately added, however, substantially free for the purpose of the present invention, does still allow for the trace amounts of sodium sulphate that are typically present in enzyme prills to be incorporated when the enzyme prill is deliberately added to the composition.

Preferably, the composition comprises from 0 wt % to 10 wt %, preferably to 8 wt %, or to 6 wt % or to 2 wt % sodium chloride. The composition may even be substantially free of sodium chloride. Substantially free means comprises no deliberately added.

The composition may comprise from 0 wt % to 10 wt % sodium carbonate, or even from 0 wt % to 8 wt %, or even from 0 wt % to 6 wt % sodium carbonate.

The composition preferably comprises less than 10 wt % reducing sugar.

Catalysts

The solid laundry detergent composition comprises multiple catalysts (i.e. more than one), preferably at least three, or at least four, or at least five, or at least six, or at least seven, or at least eight, or at least nine, or at least ten, or at least eleven, or even at least twelve catalysts.

For the purpose of the present invention, a mixture of enzymes that act on substantially the same substrate type are considered to be one catalyst. For example, two different peptidases (proteases) present in a laundry detergent composition are, for the purpose of the present invention, considered to be single catalyst. When determining the reduction in activation energy achieved by a catalyst that is a mixture of two enzymes that act on substantially the same substrate type, only one Arrhenius plot against that substrate type is used to determine the activation energy reduction, not two.

For example, if one has a laundry detergent composition comprising protease A and protease B, then only one Arrhenius plot against a protein substrate is used to determine the activation energy reduction, not two. For the purpose of the present invention, the activation energy of an uncatalysed detergent reaction is considered to be 50 $kjmol^{-1}$. Following on with this example then, if the activation energy against the protein substrate for the composition comprising protease A and protease B is 20 $kjmol^{-1}$, then the reduction in activation energy achieved by the protease present in this composition is considered to be 30 $kjmol^{-1}$ total (i.e. 50 $kjmol^{-1}$−20 $kjmol^{-1}$=30 $kjmol^{-1}$); and not 30 $kjmol^{-1}$ for protease A and another 30 $kjmol^{-1}$ for protease B (i.e. 60 $kjmol^{-1}$ is incorrect).

Preferably, the catalysts reduce the activation energy by a total of at least 100 $kjmol^{-1}$, preferably at least 120 $kjmol^{-1}$, preferably at least 140 $kjmol^{-1}$, preferably at least 160 $kjmol^{-1}$, preferably at least 180 $kjmol^{-1}$, preferably at least 200 $kjmol^{-1}$, preferably at least 220 $kjmol^{-1}$, preferably at least 240 $kjmol^{-1}$, preferably at least 260 $kjmol^{-1}$, preferably at least 280 $kjmol^{-1}$, preferably at least 300 $kjmol^{-1}$, preferably at least 320 $kjmol^{-1}$, preferably at least 340 $kjmol^{-1}$, preferably at least 360 $kjmol^{-1}$, preferably at least 380 $kjmol^{-1}$, preferably at least 400 $kjmol^{-1}$. This is the sum of the reduction in activation energy achieved by each catalyst. The method to determine the reduction in activation energy is described in more detail below.

Enzyme

Any enzyme can be a suitable catalyst. Preferred suitable catalysts are selected hemicellulases, peroxidases, proteases, xylanases, lipases, phospholipases, esterases, cutinases, pectinases, mannanases, pectate lyases, keratinases, reductases, oxidases, mono-oxygenase, di-oxygenase, carbohydrate oxidase, peroxidase, perhydrolase, choline oxidase, phenoloxidases, lipoxygenases, ligninases, pullulanases, tannases, pentosanases, malanases, β-glucanases, arabinosidases, hyaluronidase, chondroitinase, laccase, oxidoreductases, dehydrogenases, xyloglucanases, amylases, cellulases, and mixtures thereof. Other suitable catalysts include non-enzyme catalysts such as transition metal bleach catalyst, imine bleach catalyst and mixtures thereof. Mixtures of enzyme and non-enzyme catalysts are also preferred.

For the purpose of the present invention, enzymes that digest substantially the same substrate type, and therefore any combinations thereof would be considered to be one catalyst for the purpose of the present invention, are classified accordingly below:

1. Enzymes from E.C. 1.1.3.x (oxidoreductases acting on CH—OH as donor and with oxygen as acceptor)
   Examples of suitable oxidoreductases categorized as E.C. 1.1.3.x are glucose oxidase, aryl-alcohol oxidase and galactose oxidase. A suitable glucose oxidase is OxyGo® 1500 (Danisco).
2. Enzymes from E.C. 1.11.x.x (oxidoreductases acting on peroxide as acceptor)
   An example of a suitable oxidoreductase acting on peroxide as acceptor is Guardzyme® (Novozymes).
3. Enzymes from E.C. 2.3.x.x (acyltransferases)
4. Enzymes from E.C. 2.4.x.x (glycosyl transferases)
5. Enzymes from E.C. 3.1.1.1 (carboxylesterase)
6. Enzymes from E.C. 3.1.1.3 (triacylglycerol lipase)
   Lipases have E.C. classification 3.1.1.3, as defined by EC classification, IUPAC-IUBMB. Suitable lipases include both wild-types and genetically modified variants thereof possessing at least about 90%, at least about 95%, at least about 98%, or at least about 99%, or 100% identity with said lipase. In one aspect, the lipase is a variant of the wild-type lipase from *Thermomyces lanuginosus* comprising the T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)).
   Suitable commercially available lipases include Lipolase®, Lipolase Ultra®, Lipex® and Lipolex®, all available from Novozymes A/S.
7. Enzymes from E.C. 3.1.1.20 (tannase)
   Suitable tannases are disclosed in WO 06/002955A2.
8. Enzymes from E.C. 3.1.1.42 (chlorogenate hydrolase)
9. Enzymes from E.C. 3.1.1.73 (feruloyl esterase)
   Suitable ferulic acid esterases are derived from *Aspergillus awamori, Aspergillus tubingensis, Aspergillus niger, Talaromyces stipatus, Piromyces equi cellvibrio japonicus, Talaromyces stipatus* and *Clostridium Japonicus*. Further suitable ferulic acid esterases are disclosed in Acta Biochimica et Biophysica Sinica, 2007, 39(11): 811-828, which is incorporated herein by reference.
10. Enzymes from E.C. 3.1.1.74 (cutinase)
    Suitable cutinases as defined by E.C. Class 3.1.1.74. may have at least about 90% or about 95%, or about 98% identity with a wild-type from one of *Fusarium solani, Pseudomonas Mendocina* or *Humicola Insolens*.

11. Enzymes from E.C. 3.2.1.1 (α-amylase)

Alpha amylases belong to E.C. Class 3.2.1.1. Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus SP*722, especially variants with deletions in the 183 and 184 positions and variants described in WO 00/60060, which is incorporated herein by reference.

Suitable commercially available alpha-amylases are DURAMYL®, LIQUEZYME® TERMAMYL®, TERMAMYL ULTRA®, NATALASE®, SUPRAMYL®, STAINZYME®, STAINZYME PLUS®, FUNGAMYL® and BAN® (Novozymes A/S), BIOAMYLASE-D(G), BIOAMYLASE® L (Biocon India Ltd.), KEMZYM® AT 9000 (Biozym Ges. m.b.H, Austria), RAPIDASE®, PURASTAR®, OPTISIZE HT PLUS® and PURASTAR OXAM® (Genencor International Inc.) and KAM® (KAO, Japan). In one aspect, preferred amylases are NATALASE®, STAINZYME® and STAINZYME PLUS®.

12. Enzymes from E.C. 3.2.1.2 (β-amylase)

13. Enzymes from E.C. 3.2.1.4 (cellulase), E.C. 3.2.1.21 (β-glucosidase) and E.C. 3.2.1.91 (cellulose 1,4-β-cellobiosidase)

Suitable cellulases include cellulases from the genera *Bacillus, Pseudomonas, Humicola, Fusarium, Thielavia, Acremonium*, e.g. the fungal cellulases produced from *Humicola insolens, Myceliophthora thermophila, Fusarium oxysporum* disclosed in U.S. Pat. Nos. 4,435,3077, 5,648,263, 5,691,178, 5,776,757 and WO 89/09259.

Other suitable cellulases are the alkaline or neutral cellulases having colour care benefits.

Examples of such cellulases are cellulases described in EP 0 495 257, EP 0 531 372, WO 96/11262, WO 96/29397, WO 98/08940. Other examples are cellulase variants such as those described in WO 94/07998, EP 0 531 315, U.S. Pat. Nos. 5,457,046, 5,686,593, 5,763,254, WO 95/24471, WO 98/12307 and WO 99/01544, and WO 01/062903.

Commercially available cellulases include Celluclean®, Celluzyme®, Renozyme® and Carezyme®; (Novozymes A/S), Clazinase®; and Puradax HA®; (Genencor International Inc.), and KAC® 500; (Kao Corporation) and those sold under the Biotouch® and Ecostone® brand names (AB Enzymes).

Particularly suitable cellulases are variants of the Family 44 cellulase showing xyloglucanase activity disclosed in WO 2001/062903 (Novozymes).

14. Enzymes from E.C. 3.2.1.20 (α-glucosidase).

15. Enzymes from E.C. 3.2.1.25 (β-mannosidase) and E.C. 3.2.1.78 (mannan endo-1,4-β-mannosidase)

Suitable mannan endo-1,4-β-mannosidases are described in WO 99/09126, WO99/64573 and WO99/09128. Preferred mannanases are sol under the tradenames Mannaway® (Novozymes A/S) and Purabrite® (Genencor International).

16. Enzymes from E.C. 3.2.1.151 (xyloglucan-specific endo-β-1,4-glucanase).

17. Enzymes from E.C. 3.2.1.155 (xyloglucan-specific exo-β-1,4-glucanase).

18. Enzymes from E.C. 3.4.x.x (peptidases).

Suitable proteases include those of animal, vegetable or microbial origin. Microbial origin is preferred. Chemically or genetically modified mutants are included. The protease may be a serine protease, preferably an alkaline microbial protease or a trypsin-like protease.

Examples of neutral or alkaline proteases include:

(a) subtilisins (EC 3.4.21.62), especially those derived from *Bacillus*, such as *Bacillus lentus, B. alkalophilus, B. subtilis, B. amyloliquefaciens, Bacillus pumilus* and *Bacillus gibsonii*, and *Cellumonas* described in U.S. Pat. Nos. 6,312,936 B1, 5,679,630, 4,760,025, 5,030,378, WO 05/052146, DEA6022216A1 and DEA 6022224A1.

(b) trypsin-like proteases are trypsin (e.g., of porcine or bovine origin) and the *Fusarium protease described in WO* 89/06270.

(c) metalloproteases, especially those derived from *Bacillus amyloliquefaciens* described in WO 07/044993A2.

Preferred proteases are those derived from the BPN' and Carlsberg families, especially the subtilisin BPN' protease derived from *Bacillus amyloliquefaciens*. In one aspect, the protease is a variant of the subtilisin BPN' wild-type enzyme derived from *Bacillus amyloliquefaciens* that contains the Y217L mutation. The subtilisin BPN' wild-type enzyme sequence is the 275 amino acids (amino acids 108-382) of the Swissprot accession no. P00782 (derived from *Bacillus amyloliquefaciens*).

Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, and those sold under the tradename Opticlean® and Optimase® by Solvay Enzymes.

In one aspect, the preferred protease is that sold under the tradename Purafect Prime®, supplied by Genencor International.

19. Enzymes from E.C. 4.2.2.2 (pectate lyase)

In one aspect the enzyme may comprise a pectate lyase. Suitable pectate lyases are described in WO 00/42151 and WO 00/42147. Preferred pectate lyases are sold under the tradenames Pectawash® and Pectaway® by Novozymes A/S.

20. Enzymes from E.C. 4.2.2.10 (pectin lyase)

Transition Metal Bleach Catalyst

Transition metal bleach catalysts are suitable catalysts. The transition metal bleach catalyst typically comprises a transition metal ion, preferably selected from transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), more preferably Mn(II), Mn(III), Mn(IV), Fe(II), Fe(III), Cr(II), Cr(III), Cr(IV), Cr(V), and Cr(VI).

The transition metal bleach catalyst typically comprises a ligand, preferably a macropolycyclic ligand, more preferably a cross-bridged macropolycyclic ligand. The transition metal ion is preferably coordinated with the ligand. Preferably, the ligand comprises at least four donor atoms, at least two of which are bridgehead donor atoms.

Preferably, the cross-bridged macropolycyclic ligand is coordinated by four or five donor atoms to the same transition metal and comprises:

(i) an organic macrocycle ring containing four or more donor atoms selected from N and optionally O and S, at least two of these donor atoms being N (preferably at least 3, more preferably at least 4, of these donor atoms are N), separated from each other by covalent linkages of 2 or 3 non-donor atoms, two to five (preferably three to four, more preferably four) of these donor atoms being coordinated to the same transition metal in the complex;

(ii) a cross-bridging chain which covalently connects at least 2 non-adjacent N donor atoms of the organic macrocycle ring, said covalently connected non-adjacent N donor atoms being bridgehead N donor atoms which are coordinated to the same transition metal in the complex, and wherein said cross-bridged chain comprises from 2 to about 10 atoms (preferably the cross-bridged chain is selected from 2, 3 or 4 non-donor atoms, and 4-6 non-donor atoms with a further, preferably N, donor atom); and (iii) optionally, one or more non-macropolycyclic ligands, preferably selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl.

A suitable transition metal bleach catalyst comprises a complex of a transition metal and a macropolycyclic rigid ligand, preferably a cross-bridged macropolycyclic ligand, wherein:

(1) said transition metal is selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV);

(2) said macropolycyclic rigid ligand is coordinated by at least four, preferably four or five, donor atoms to the same transition metal and comprises:

(i) an organic macrocycle ring containing four or more donor atoms (preferably at least 3, more preferably at least 4, of these donor atoms are N) separated from each other by covalent linkages of at least one, preferably 2 or 3, non-donor atoms, two to five (preferably three to four, more preferably four) of these donor atoms being coordinated to the same transition metal in the complex;

(ii) a linking moiety, preferably a cross-bridging chain, which covalently connects at least 2 (preferably non-adjacent) donor atoms of the organic macrocycle ring, said covalently connected (preferably non-adjacent) donor atoms being bridgehead donor atoms which are coordinated to the same transition metal in the complex, and wherein said linking moiety (preferably a cross-bridged chain) comprises from 2 to about 10 atoms (preferably the cross-bridged chain is selected from 2, 3 or 4 non-donor atoms, and 4-6 non-donor atoms with a further donor atom), including for example, a cross-bridge which is the result of a Mannich condensation of ammonia and formaldehyde; and (iii) optionally, one or more non-macropolycyclic ligands, preferably monodentate ligands, such as those selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl (specific examples of monodentate ligands including phenolate, acetate or the like).

Suitable cross-bridged macropolycyclic ligands include:

(i) the cross-bridged macropolycyclic ligand of formula (I) having denticity of 4 or 5:

(I)

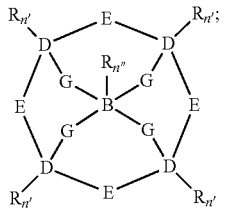

(ii) the cross-bridged macropolycyclic ligand of formula (II) having denticity of 5 or 6:

(II)

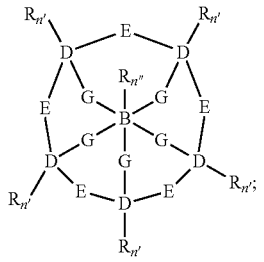

(iii) the cross-bridged macropolycyclic ligand of formula (III) having denticity of 6 or 7:

(III)

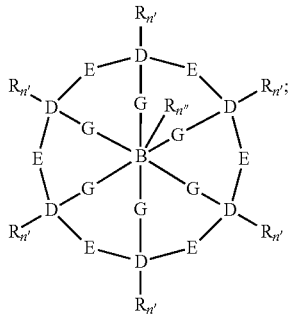

wherein in these formulas:

each "E" is the moiety $(CR_n)_a$—X—$(CR_n)_{a'}$, wherein —X— is selected from the group consisting of O, S, NR and P, or a covalent bond, and preferably X is a covalent bond and for each E the sum of a+a' is independently selected from 1 to 5, more preferably 2 and 3;

each "G" is the moiety $(CR_n)_b$;

each "R" is independently selected from H, alkyl, alkenyl, alkynyl, aryl, alkylaryl (e.g., benzyl), and heteroaryl, or two or more R are covalently bonded to form an aromatic, heteroaromatic, cycloalkyl, or heterocycloalkyl ring;

each "D" is a donor atom independently selected from the group consisting of N, O, S, and P, and at least two D atoms are bridgehead donor atoms coordinated to the transition metal (in the preferred embodiments, all donor atoms designated D are donor atoms which coordinate to the transition metal, in contrast with heteroatoms in the structure which are not in D such as those which may be present in E; the non-D heteroatoms can be non-coordinating and indeed are non-coordinating whenever present in the preferred embodiment);

"B" is a carbon atom or "D" donor atom, or a cycloalkyl or heterocyclic ring;

each "n" is an integer independently selected from 1 and 2, completing the valence of the carbon atoms to which the R moieties are covalently bonded;

each "n" is an integer independently selected from 0 and 1, completing the valence of the D donor atoms to which the R moieties are covalently bonded;

each "n"" is an integer independently selected from 0, 1, and 2 completing the valence of the B atoms to which the R moieties are covalently bonded;

each "a" and "a'" is an integer independently selected from 0-5, preferably a+a' equals 2 or 3, wherein the sum of all "a" plus "a" in the ligand of formula (I) is within the range of from about 6 (preferably 8) to about 12, the sum of all "a" plus "a'" in the ligand of formula (II) is within the range of from about 8 (preferably 10) to about 15, and the sum of all "a" plus "a'" in the ligand of formula (III) is within the range of from about 10 (preferably 12) to about 18;

each "b" is an integer independently selected from 0-9, preferably 0-5 (wherein when b=0, $(CR_n)_0$ represents a covalent bond), or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all "b" is within the range of from about 1 to about 5.

A suitable cross-bridged macropolycyclic ligand is selected from the group consisting of:

(I)

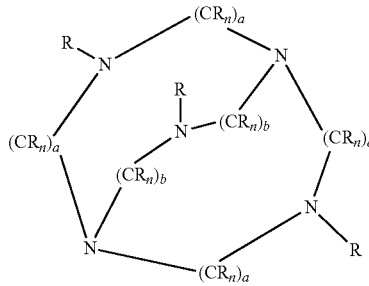

and (II)

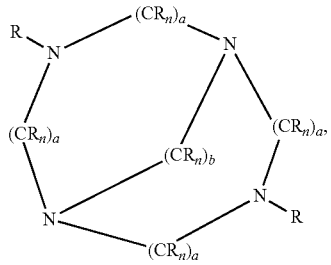

wherein in these formulas:

each "R" is independently selected from H, alkyl, alkenyl, alkynyl, aryl, alkylaryl (e.g., benzyl) and heteroaryl, or two or more R are covalently bonded to form an aromatic, heteroaromatic, cycloalkyl, or heterocycloalkyl ring;

each "n" is an integer independently selected from 0, 1 and 2, completing the valence of the carbon atoms to which the R moieties are covalently bonded;

each "b" is an integer independently selected from 2 and 3; and each "a" is an integer independently selected from 2 and 3.

Suitable transition metal bleach catalysts include: Dichloro-5,12-dimethyl-1,5,8,12-tetraazabicyclo[6.6.2]hexadecane Manganese(II); Dichloro-4,10-dimethyl-1,4,7,10-tetraazabicyclo[5.5.2]tetradecane Manganese(II); Diaquo-5,12-dimethyl-1,5,8,12-tetraazabicyclo[6.6.2]hexadecane Manganese(II) Hexafluorophosphate; Aquo-hydroxy-5,12-dimethyl-1,5,8,12-tetraazabicyclo[6.6.2]hexadecane Manganese(III) Hexafluorophosphate; Diaquo-4,10-dimethyl-1,4,7,10-tetraazabicyclo[5.5.2]tetradecane Manganese(II) Hexafluorophosphate; Diaquo-5,12-dimethyl-1,5,8,12-tetraazabicyclo[6.6.2]hexadecane Manganese(II) Tetrafluoroborate; Diaquo-4,10-dimethyl-1,4,7,10-tetraazabicyclo[5.5.2]tetradecane Manganese(II) Tetrafluoroborate; Dichloro-5,12-dimethyl-1,5,8,12-tetraazabicyclo[6.6.2]hexadecane Manganese(III); Hexafluorophosphate; Dichloro-5,12-di-n-butyl-1,5,8,12-tetraaza-bicyclo[6.6.2]hexadecane Manganese(II); Dichloro-5,12-dibenzyl-1,5,8,12-tetraazabicyclo[6.6.2]hexadecane Manganese(II); Dichloro-5-n-butyl-12-methyl-1,5,8,12-tetraaza-bicyclo[6.6.2]hexadecane Manganese(II); Dichloro-5-n-octyl-12-methyl-1,5,8,12-tetraazabicyclo[6.6.2]hexadecane Manganese(II); Dichloro-5-n-butyl-12-methyl-1,5,8,12-tetraaza-bicyclo[6.6.2]hexadecane Manganese(II); Dichloro-5,12-dimethyl-1,5, 8,12-tetraazabicyclo[6.6.2]hexadecane Iron(II); Dichloro-4,10-dimethyl-1,4,7,10-tetraazabicyclo[5.5.2]tetradecane Iron(II); Dichloro-5,12-dimethyl-1,5,8,12-tetraazabicyclo[6.6.2]hexadecane Copper(II); Dichloro-4,10-dimethyl-1,4,7,10-tetraazabicyclo[5.5.2]tetradecane Copper(II); Dichloro-5,12-dimethyl-1,5,8,12-tetraazabicyclo[6.6.2]hexadecane Cobalt(II); Dichloro-4,10-dimethyl-1,4,7,10-tetraazabicyclo[5.5.2]tetradecane Cobalt(II); Dichloro 5,12-dimethyl-4-phenyl-1,5,8,12-tetraazabicyclo[6.6.2]hexadecane Manganese(II); Dichloro-4,10-dimethyl-3-phenyl-1,4,7,10-tetraazabicyclo[5.5.2]tetradecane Manganese(II); Dichloro-5,12-dimethyl-4,9-diphenyl-1,5,8,12-tetraazabicyclo[6.6.2]hexadecane Manganese(II); Dichloro-4,10-dimethyl-3,8-diphenyl-1,4,7,10-tetraazabicyclo[5.5.2]tetradecane Manganese(II); Dichloro-5,12-dimethyl-2,11-diphenyl-1,5,8,12-tetraazabicyclo[6.6.2]hexadecane Manganese(II); Dichloro-4,10-dimethyl-4,9-diphenyl-1,4,7,10-tetraazabicyclo[5.5.2]tetradecane Manganese(II); Dichloro-2,4,5,9,11,12-hexamethyl-1,5,8,12-tetraazabicyclo[6.6.2]hexadecane Manganese(II); Dichloro-2,3,5,9,10,12-hexamethyl-1,5,8,12-tetraazabicyclo[6.6.2]hexadecane Manganese(II); Dichloro-2,2,4,5,9,9,11,12-octamethyl-1,5,8,12-tetraazabicyclo[6.6.2]hexadecane Manganese(II); Dichloro-2,2,4,5,9,11,11,12-octamethyl-1,5,8,12-tetraazabicyclo[6.6.2]hexadecane Manganese(II); Dichloro-3,3,5,10,10,12-hexamethyl-1,5,8,12-tetraazabicyclo[6.6.2]hexadecane Manganese(II); Dichloro-3,5,10,12-tetramethyl-1,5,8,12-tetraazabicyclo[6.6.2]hexadecane Manganese(II); Dichloro-3-butyl-5,10,12-trimethyl-1,5,8,12-tetraazabicyclo[6.6.2]hexadecane Manganese(II); Dichloro-1,5,8,12-tetraazabicyclo[6.6.2]hexadecane Manganese(II); Dichloro-1,4,7,10-tetraazabicyclo[5.5.2]tetradecane Manganese(II); Dichloro-1,5,8,12-tetraazabicyclo[6.6.2]hexadecane Iron(II); Dichloro-1,4,7,10-tetraazabicyclo[5.5.2]tetradecane Iron(II); Aquo-chloro-2-(2-hydroxyphenyl)-5,12-dimethyl,5,8,12-tetraazabicyclo[6.6.2]hexadecane Manganese(II); Aquo-chloro-10-(2-hydroxybenzyl)-4,10-dimethyl-1,4,7,10-tetraazabicyclo[5.5.2]tetradecane Manganese(II); Chloro-2-(2-hydroxybenzyl)-5-methyl,5,8,12-tetraazabicyclo[6.6.2]hexadecane Manganese(II); Chloro-10-(2-hydroxybenzyl)-4-methyl-1,4,7,10-tetraazabicyclo[5.5.2]tetradecane Manganese(II); Chloro-5-methyl-12-(2-picolyl)-1,5,8,12-tetraazabicyclo[6.6.2]hexadecane Manganese(II) Chloride; Chloro-4-methyl-10-(2-picolyl)-1,4,7,10-tetraazabicyclo[5.5.2]tetradecane Manganese(II) Chloride; Dichloro-5-(2-sulfato)dodecyl-12-methyl-1,5,8,12-tetraazabicyclo[6.6.2]hexadecane Manganese(III); Aquo-Chloro-5-(2-sulfato)dodecyl-12-methyl-1,5,8,12-tetraazabicyclo[6.6.2]hexadecane Manganese(II); Aquo-Chloro-5-(3-sulfonopropyl)-12-methyl-1,5,8,12-tetraazabicyclo[6.6.2]hexadecane Manganese(II); Dichloro-5-(Trimethylammoniopropyl)dodecyl-12-methyl-1,5,8,12-tetraazabicyclo[6.6.2]hexadecane Manganese(III) Chloride; Dichloro-5,12-dimethyl-1,4,7,10,13-pentaazabicyclo[8.5.2]heptadecane Manganese(II); Dichloro-14,20-dimethyl-1,10,14,20-tetraazatricyclo[8.6.6]docosa-3(8),4,6-triene Manganese(II); Dichloro-4,11-dimethyl-1,4,7,11-tetraazabicyclo[6.5.2]pentadecane Manganese(II); Dichloro-5,12-dimethyl-1,5,8,12-tetraazabicyclo[7.6.2]heptadecane Manganese(II); Dichloro-5,13-dimethyl-1,5,9,13-tetraazabicyclo[7.7.2]heptadecane Manganese(II); Dichloro-3,10-bis(butylcarboxy)-5,12-dimethyl-1,5,8,12-tetraazabicyclo[6.6.2]hexadecane Manganese(II); Diaquo-3,10-dicarboxy-5,12-dimethyl-1,5,8,12-tetraazabicyclo[6.6.2]hexadecane Manganese(II); Chloro-20-methyl-1,9,20,24,25-pentaaza-tetracyclo[7.7.7.13,7.111,15.]pentacosa-3,5,7(24),11,13,15(25)-hexaene manganese(II) Hexafluorophosphate; Trifluoromethanesulfono-20-methyl-1,9,20,24,25-pentaaza-tetracyclo[7.7.7.13,7.111,15.]pentacosa-3,5,7(24),11,13,15(25)-hexaene Manganese(II) Trifluoromethanesulfonate; Trifluoromethanesulfono-20-methyl-1,9,20,24,25-pentaaza-tetracyclo[7.7.7.13,7.111,15.]pentacosa-3,5,7(24),11,13,15(25)-hexaene Iron(II) Trifluoromethanesulfonate; Chloro-5,12,17-trimethyl-1,5,8,12,17-pentaazabicyclo[6.6.5]nonadecane Manganese (II) Hexafluorophosphate; Chloro-4,10,15-trimethyl-1,4,7,10,15-pentaazabicyclo[5.5.5]heptadecane Manganese (II) Hexafluorophosphate; Chloro-5,12,17-trimethyl-1,5,8,12,17-pentaazabicyclo[6.6.5]nonadecane Manganese (II) Chloride; Chloro-4,10,15-trimethyl-1,4,7,10,15-pentaazabicyclo[5.5.5]heptadecane Manganese(II) Chloride; Dichloro-5,12-diethyl-1,5,8,12-tetraazabicyclo[6.6.2]hexadecanemanganese; dichloro-4,11 diethyl-1,4,8,11 tetraazabicyclo (6.6.2) hexadecane manganese (II); and any mixture thereof.

Other suitable transition metal bleach catalysts are described in U.S. Pat. Nos. 5,580,485, 4,430,243; 4,728,455; 5,246,621; 5,244,594; 5,284,944; 5,194,416; 5,246,612; 5,256,779; 5,280,117; 5,274,147; 5,153,161; 5,227,084; 5,114,606; 5,114,611, EP 549,271 A1; EP 544,490 A1; EP 549,272 A1; and EP 544,440 A2.

A suitable transition metal bleach catalyst is a manganese-based catalyst, for example disclosed in U.S. Pat. No. 5,576,282.

Suitable cobalt bleach catalysts are described, for example, in U.S. Pat. Nos. 5,597,936 and 5,595,967. Such cobalt catalysts are readily prepared by known procedures, such as taught for example in U.S. Pat. Nos. 5,597,936, and 5,595,967.

A suitable transition metal bleach catalyst is a transition metal complex of ligand such as bispidones described in WO 05/042532 A1.

Imine Bleach Catalyst

Imine bleach catalysts are suitable catalysts. Suitable imine bleach catalysts include, but are not limited to: iminium cations and polyions; iminium zwitterions; N-sulphonyl imines; N-phosphonyl imines; N-acyl imines; perfluoroimines; and mixtures thereof.

Suitable iminium cations and polyions include, but are not limited to, N-methyl-3,4-dihydroisoquinolinium tetrafluoroborate, prepared as described in Tetrahedron (1992), 49(2), 423-38 (see, for example, compound 4, p. 433); N-methyl-3,4-dihydroisoquinolinium p-toluene sulphonate, prepared as described in U.S. Pat. No. 5,360,569 (see, for example, Column 11, Example 1); and N-octyl-3,4-dihydroisoquinolinium p-toluene sulphonate, prepared as described in U.S. Pat. No. 5,360,568 (see, for example, Column 10, Example 3).

Suitable iminium zwitterions include, but are not limited to, N-(3-sulfopropyl)-3,4-dihydroisoquinolinium, inner salt, prepared as described in U.S. Pat. No. 5,576,282 (see, for example, Column 31, Example II); N-[2-(sulphooxy)dodecyl]-3,4-dihydroisoquinolinium, inner salt, prepared as described in U.S. Pat. No. 5,817,614 (see, for example, Column 32, Example V); 243-[(2-ethylhexyl)oxy]-2-(sulphooxy)propyl]-3,4-dihydroisoquinolinium, inner salt, prepared as described in WO05/047264 (see, for example, page 18, Example 8), and 2-[3(2-butyloctyl)oxy]-2-(sulphooxy)propyl]-3,4-dihydroisoquinolinium, inner salt.

Suitable N-sulphonyl imine oxygen transfer catalysts include, but are not limited to, 3-methyl-1,2-benzisothiazole 1,1-dioxide, prepared according to the procedure described in the Journal of Organic Chemistry (1990), 55(4), 1254-61.

Suitable N-phosphonyl imine oxygen transfer catalysts include, but are not limited to, [R-(E)]-N-[(2-chloro-5-nitrophenyl)methylene]-P-phenyl-P-(2,4,6-trimethylphenyl)-phosphinic amide, which can be made according to the procedures described in the Journal of the Chemical Society, Chemical Communications (1994), (22), 2569-70.

Suitable N-acyl imine oxygen transfer catalysts include, but are not limited to, [N(E)]-N-(phenylmethylene)acetamide, which can be made according to the procedures described in Polish Journal of Chemistry (2003), 77(5), 577-590.

Suitable perfluoroimine oxygen transfer catalysts include, but are not limited to, (Z)-2,2,3,3,4,4,4-heptafluoro-N-(nonafluorobutyl)butanimidoyl fluoride, which can be made according to the procedures described in Tetrahedron Letters (1994), 35(34), 6329-30.

Suitable cyclic sugar ketone oxygen transfer catalysts include, but are not limited to, 1,2:4,5-di-O-isopropylidene-D-erythro-2,3-hexodiuro-2,6-pyranose as prepared in U.S. Pat. No. 6,649,085 (Column 12, Example 1).

Preferably, the imine bleach catalyst comprises an iminium and/or carbonyl functional group and is typically capable of forming an oxaziridinium and/or dioxirane functional group upon acceptance of an oxygen atom, especially upon acceptance of an oxygen atom from a peroxyacid and/or salt thereof. Preferably, the imine bleach catalyst comprises an oxaziridinium functional group and/or is capable of forming an oxaziridinium functional group upon acceptance of an oxygen atom, especially upon acceptance of an oxygen atom from a peroxyacid and/or salt thereof. Preferably, the imine bleach catalyst comprises a cyclic iminium functional group, preferably wherein the cyclic moiety has a ring size of from five to eight atoms (including the nitrogen atom), preferably six atoms. Preferably, the imine bleach catalyst comprises an aryliminium functional group, preferably a bi-cyclic aryliminium functional group, preferably a 3,4-dihydroisoquinolinium functional group. Typically, the imine functional group is a quaternary imine functional group and is typically capable of forming a quaternary oxaziridinium functional group upon acceptance of an oxygen atom, especially upon acceptance of an oxygen atom from a peroxyacid and/or salt thereof.

Preferably, the imine bleach catalyst has a chemical structure corresponding to the following chemical formula

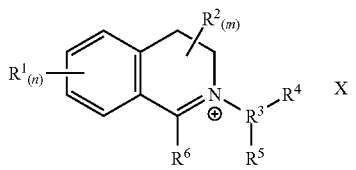

wherein: n and m are independently from 0 to 4, preferably n and m are both 0; each $R^1$ is independently selected from a substituted or unsubstituted radical selected from the group consisting of hydrogen, alkyl, cycloalkyl, aryl, fused aryl, heterocyclic ring, fused heterocyclic ring, nitro, halo, cyano, sulphonato, alkoxy, keto, carboxylic, and carboalkoxy radicals; and any two vicinal $R^1$ substituents may combine to form a fused aryl, fused carbocyclic or fused heterocyclic ring; each $R^2$ is independently selected from a substituted or unsubstituted radical independently selected from the group consisting of hydrogen, hydroxy, alkyl, cycloalkyl, alkaryl, aryl, aralkyl, alkylenes, heterocyclic ring, alkoxys, arylcarbonyl groups, carboxyalkyl groups and amide groups; any $R^2$ may be joined together with any other of $R^2$ to form part of a common ring; any geminal $R^2$ may combine to form a carbonyl; and any two $R^2$ may combine to form a substituted or unsubstituted fused unsaturated moiety; $R^3$ is a $C_1$ to $C_{20}$ substituted or unsubstituted alkyl; $R^4$ is hydrogen or the moiety Q-A, wherein: Q is a branched or unbranched alkylene, t=0 or 1 and A is an anionic group selected from the group consisting of $OSO_3^-$, $SO_3^-$, $CO_2^-$, $OCO_2^-$, $OPO_3^{2-}$, $OPO_3H^-$ and $OPO_2^-$; $R^5$ is hydrogen or the moiety $—CR^{11}R^{12}—Y-G_b-Y_c—[(CR^9R^{10})_y—O]_k—R^8$, wherein: each Y is independently selected from the group consisting of O, S, N—H, or N—$R^8$; and each $R^8$ is independently selected from the group consisting of alkyl, aryl and heteroaryl, said moieties being substituted or unsubstituted, and whether substituted or unsubstituted said moieties having less than 21 carbons; each G is independently selected from the group consisting of CO, $SO_2$, SO, PO and $PO_2$; $R^9$ and $R^{10}$ are independently selected from the group consisting of H and $C_1$-$C_4$ alkyl; $R^{11}$ and $R^{12}$ are independently selected from the group consisting of H and alkyl, or when taken together may join to form a carbonyl; b=0 or 1; c can=0 or 1, but c must=0 if b=0; y is an integer from 1 to 6; k is an integer from 0 to 20; $R^6$ is H, or an alkyl, aryl or heteroaryl moiety; said moieties being substituted or unsubstituted; and X, if present, is a suitable charge balancing counterion, preferably X is present when $R^4$ is hydrogen, suitable X, include but are not limited to: chloride, bromide, sulphate, methosulphate, sulphonate, p-toluenesulphonate, borontetraflouride and phosphate.

In one embodiment of the present invention, the imine bleach catalyst has a structure corresponding to general formula below:

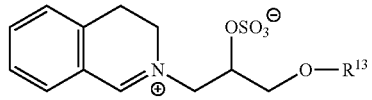

wherein $R^{13}$ is a branched alkyl group containing from three to 24 carbon atoms (including the branching carbon atoms) or a linear alkyl group containing from one to 24 carbon atoms; preferably $R^{13}$ is a branched alkyl group containing from eight to 18 carbon atoms or linear alkyl group containing from eight to eighteen carbon atoms; preferably $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl; preferably $R^{13}$ is selected from the group consisting of 2-butyloctyl, 2-pentylnonyl, 2-hexyldecyl, iso-tridecyl and iso-pentadecyl.

In another embodiment of the present invention, the imine bleach catalyst has a structure corresponding to general formula below or mixtures thereof.

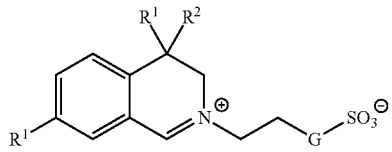

wherein: G is selected from —O—, —$CH_2$O—, —$(CH_2)_2$—, and —$CH_2$—. $R^1$ is selected from H or $C_1$-$C_4$ alkyl. Suitable $C_1$-$C_4$ alkyl moieties include, but are not limited to methyl, ethyl, iso-propyl, and tert-butyl. Each $R^2$ is independently selected from $C_4$-$C_8$ alkyl, benzyl, 2-methylbenzyl, 3-methylbenzyl, 4-methylbenzyl, 4-ethylbenzyl, 4-iso-propylbenzyl and 4-tert-butylbenzyl. Suitable $C_4$-$C_8$ alkyl moieties include, but are not limited to n-butyl, n-pentyl, cyclopentyl, n-hexyl, cyclohexyl, cyclohexylmethyl, n-heptyl and octyl.

In one aspect of the invention G is selected from —O— and —$CH_2$—. $R^1$ is selected from H, methyl, ethyl, iso-propyl, and tert-butyl. Each $R^2$ is independently selected from $C_4$-$C_6$ alkyl, benzyl, 2-methylbenzyl, 3-methylbenzyl, and 4-methylbenzyl.

In another aspect of the invention G is —$CH_2$—, $R^1$ is H and each $R^2$ is independently selected from n-butyl, n-pentyl, n-hexyl, benzyl, 2-methylbenzyl, 3-methylbenzyl, and 4-methylbenzyl.

Zeolite Builder

Preferably, the composition comprise from 0 wt % to 10 wt % zeolite builder, preferably to 8 wt %,or to 6 wt %, or to 4 wt %, or even to 2 wt % zeolite builder. The composition may even be substantially free of zeolite builder, substantially free means "no deliberately added". Typical zeolite builders are zeolite A, zeolite P and zeolite MAP.

Phosphate Builder

Preferably, the composition comprise from 0 wt % to 10 wt % phosphate builder, preferably to 8 wt %,or to 6 wt %, or to 4 wt %, or even to 2 wt % phosphate builder. The composition may even be substantially free of phosphate builder, substantially free means "no deliberately added". A typical phosphate builder is sodium tri-polyphosphate.

Silicate Salt

The composition may comprise from 0 wt % to 10 wt % silicate salt, preferably to 8 wt %, or to 6 wt %, or to 4 wt %, or even to 2 wt % silicate salt. The composition may even be substantially free of silicate salt, substantially free means "no deliberately added". Typical silicate salts are sodium silicate, such as 1.6 R sodium silicate and/or 2.0 R sodium silicate.

Detersive Surfactant

The composition preferably comprises detersive surfactant, preferably from 10 wt % to 40 wt %, preferably from 12 wt %, or from 15 wt %, or even from 18 wt % detersive surfactant. However, it may also be preferred for the composition to comprise very low levels of ionic surfactant. Preferably, the weight ratio of non-ionic detersive surfactant to ionic detersive surfactant is at least 0.5:1, preferably at least 0.6:1, or at least 0.7:1, or at least 0.8:1, or at least 0.9:1, or at least 1:1, or at least 1.5:1, or at least 2.0:1, or at least 2.5:1, or at least 3.0:1, or at least 3.5:1, or at least 4:1, or at least 5:1, or at least 10:1, or even at least 20:1. Preferably, the surfactant comprises alkyl benzene sulphonate and one or more detersive co-surfactants. The surfactant preferably comprises $C_{10}$-$C_{13}$ alkyl benzene sulphonate and one or more co-surfactants. The co-surfactants preferably are selected from the group consisting of $C_{12}$-$C_{18}$ alkyl ethoxylated alcohols, preferably having an average degree of ethoxylation of from 1 to 7; $C_{12}$-$C_{18}$ alkyl ethoxylated sulphates, preferably having an average degree of ethoxylation of from 1 to 5; and mixtures thereof. However, other surfactant systems may be suitable for use in the present invention.

Suitable detersive surfactants include anionic detersive surfactants, nonionic detersive surfactants, cationic detersive surfactants, zwitterionic detersive surfactants, amphoteric detersive surfactants and mixtures thereof.

Suitable anionic detersive surfactants include: alkyl sulphates; alkyl sulphonates; alkyl phosphates; alkyl phosphonates; alkyl carboxylates; and mixtures thereof. The anionic surfactant can be selected from the group consisting of: $C_{10}$-$C_{18}$ alkyl benzene sulphonates (LAS) preferably $C_{10}$-$C_{13}$ alkyl benzene sulphonates; $C_{10}$-$C_{20}$ primary, branched chain, linear-chain and random-chain alkyl sulphates (AS), typically having the following formula:

$$CH_3(CH_2)xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

$$CH_3(CH_2)_x(\underset{\displaystyle OSO_3^-M^+}{\underset{|}{CH}})CH_3 \quad \text{or} \quad CH_3(CH_2)_y(\underset{\displaystyle OSO_3^-M^+}{\underset{|}{CH}})CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. Nos. 6,020,303 and 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS) and mixtures thereof.

Preferred anionic detersive surfactants include: linear or branched, substituted or unsubstituted alkyl benzene sulphonate detersive surfactants, preferably linear $C_8$-$C_{18}$ alkyl benzene sulphonate detersive surfactants; linear or branched, substituted or unsubstituted alkyl benzene sulphate detersive surfactants; linear or branched, substituted or unsubstituted alkyl sulphate detersive surfactants, including linear $C_8$-$C_{18}$ alkyl sulphate detersive surfactants, $C_1$-$C_3$ alkyl branched $C_8$-$C_{18}$ alkyl sulphate detersive surfactants, linear or branched alkoxylated $C_8$-$C_{18}$ alkyl sulphate detersive surfactants and mixtures thereof; linear or branched, substituted or unsubstituted alkyl sulphonate detersive surfactants; and mixtures thereof.

Preferred alkoxylated alkyl sulphate detersive surfactants are linear or branched, substituted or unsubstituted $C_{8-18}$ alkyl alkoxylated sulphate detersive surfactants having an average degree of alkoxylation of from 1 to 30, preferably from 1 to 10. Preferably, the alkoxylated alkyl sulphate detersive surfactant is a linear or branched, substituted or unsubstituted $C_{8-18}$ alkyl ethoxylated sulphate having an average degree of ethoxylation of from 1 to 10. Most preferably, the alkoxylated alkyl sulphate detersive surfactant is a linear unsubstituted $C_{8-18}$ alkyl ethoxylated sulphate having an average degree of ethoxylation of from 3 to 7.

Preferred anionic detersive surfactants are selected from the group consisting of: linear or branched, substituted or unsubstituted, $C_{12-18}$ alkyl sulphates; linear or branched, substituted or unsubstituted, $C_{10-13}$alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Suitable cationic detersive surfactants include: alkyl pyridinium compounds; alkyl quaternary ammonium compounds; alkyl quaternary phosphonium compounds; alkyl ternary sulphonium compounds; and mixtures thereof. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. Nos. 4,228,042, 4,239,660, 4,260,529 and 6,022,844; amino surfactants as described in more detail in U.S. Pat. No. 6,221,825 and WO 00/47708, specifically amido propyldimethyl amine; and mixtures thereof. Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include halides (such as chloride), sulphate and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Suitable non-ionic detersive surfactant can be selected from the group consisting of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. Nos. 6,153,577, 6,020,303 and 6,093,856; alkylpolysaccharides as described in more detail in U.S. Pat. No. 4,565;647, specifically alkylpolyglycosides as described in more detail in U.S. Pat. Nos. 4,483,780 and4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

Polymeric Carboxylate

The composition preferably comprises polymeric carboxylate. It may be preferred for the composition to comprise at least 5 wt % or at least 6 wt %, or at least 7 wt %, or at least 8 wt %, or even at least 9 wt %, by weight of the composition, of polymeric carboxylate. The polymeric carboxylate can sequester free calcium ions in the wash liquor. The carboxylate polymers can also act as soil dispersants and can provide an improved particulate stain removal cleaning benefit. Preferred polymeric carboxylates include: polyacrylates, preferably having a weight average molecular weight of from 1,000 Da to 20,000 Da; co-polymers of maleic acid and acrylic acid, preferably having a molar ratio of maleic acid monomers to acrylic acid monomers of from 1:1 to 1:10 and a weight average molecular weight of from 10,000 Da to 200,000 Da, or preferably having a molar ratio of maleic acid monomers to acrylic acid monomers of from 0.3:1 to 3:1 and a weight average molecular weight of from 1,000 Da to 50,000 Da.

Enzyme Stabilization

Preferably, the composition comprises an enzyme stabilization means. Suitable enzyme stabilization means are described in more detail below.

As used herein, "mass efficient reversible protease inhibitors" are protease inhibitors that have a $K_1$ of from about 0.00001 mM to about 10 mM, from about 0.0001 mM to about 5 mM, from about 0.005 mM to about 2 mM, or even from about 0.001 mM to about 0.5 mM.

As used herein "encapsulated proteases" are encapsulated proteases having an average particle size of from about 0.05 microns to about 1000 microns, or from about 0.2 microns to about 700 microns or even from about 0.5 microns to about 150 microns. When said encapsulated proteases are in the form of enzyme granulates/prills, said encapsulated proteases typically have particle size of from about 200 microns to about 1000 microns. When said encapsulated proteases are in the form of enzyme microcapsules, said microcapsules typically have a particle size of from about 100 microns to about 0.05 microns, from about 80 microns to about 0.05 microns, or even from about 50 microns to about 0.05 microns.

Protease stabilization systems can be selected from one or more of the group comprising:

(a) Boronic acid, borates and salts thereof, preferably formulated with diols;

(b) Mass efficient reversible protease inhibitors;

(c) Encapsulated proteases

Suitable mass efficient reversible protease inhibitors for the inhibition of serine proteases would include derivates of boronic acid, especially phenyl boronic acid and derivatives thereof and peptide aldehydes, including tripeptide aldehydes. Examples of such compounds are disclosed in WO 98/13458 A1, WO 07/113241 A1, and U.S. Pat. No. 5,972,873.

In one aspect of the present invention, the stabilizer may be selected from the group consisting of thiophene-2 boronic acid, thiophene-3 boronic acid, acetamidophenyl boronic acid, benzofuran-2 boronic acid, naphtalene-1 boronic acid, naphtalene-2 boronic acid, 2-fomyl phenyl boronic acid (2-FPBA), 3-FBPA, 4-FPBA, 1-thianthrene boronic acid, 4-dibenzofuran boronic acid, 5-methylthiophene-2 boronic, acid, thionaphtrene boronic acid, furan-2 boronic acid, furan-3 boronic acid, 4,4 biphenyldiboronic acid, 6-hydroxy-2-naphtalene, 4-(methylthio)phenyl boronic acid, 4 (trimethylsilyl)phenyl boronic acid, 3-bromothiophene boronic acid, 4-methylthiophene boronic acid, 2-naphthyl boronic acid, 5-bromothiphene boronic acid, 5-chlorothiophene boronic acid, dimethylthiophene boronic acid, 2-bromophenyl boronic acid, 3-chlorophenyl boronic acid, 3-methoxy-2-thiophene, p-methyl-phenylethyl boronic acid, 2-thianthrene boronic acid, di-benzothiophene boronic acid, 4-carboxyphenyl boronic acid, 9-anthryl boronic acid, 3,5 dichlorophenyl boronic, acid, diphenyl boronic acidanhydride, o-chlorophenyl boronic acid, p-chlorophenyl boronic acid m-bromophenyl boronic acid, p-bromophenyl boronic acid, p-fluorophenyl boronic acid, p-tolyl boronic acid, o-tolyl boronic acid, octyl boronic acid, 1,3,5 trimethylphenyl boronic acid, 3-chloro-4-flourophenyl boronic acid, 3-aminophenyl boronic acid, 3,5-bis-(trifluoromethyl) phenyl boronic acid, 2,4 dichlorophenyl boronic acid, 4-methoxyphenyl boronic acid and mixtures thereof. Further suitable boronic acid derivatives suitable as stabilizers are described in U.S. Pat. Nos. 4,963,655, 5,159,060, WO 95/12655, WO 95/29223, WO 92/19707, WO 94/04653, WO 94/04654, U.S. Pat. Nos. 5,442,100, 5,488,157 and 5,472,628.

In one aspect, the mass efficient reversible protease inhibitor may comprise 4-formyl phenyl boronic acid.

In one aspect, the mass efficient reversible protease inhibitor comprises a reversible peptide protease inhibitor. Examples of suitable reversible peptide protease inhibitors and processes for making same may be found in U.S. Pat. No. 6,165,966 and WO 98/13459 A1.

In one aspect, the tripeptide enzyme inhibitor has the following structure:

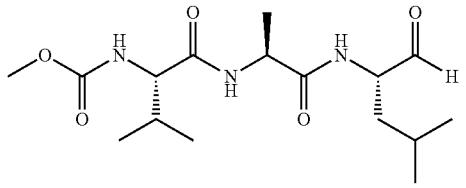

Suitable mass efficient reversible inhibitors for metalloproteases may be selected from the group consisting of:

(i) phosphoramidon and/or peptide isosteric phosphinamides;

(ii) thiols, including, in one aspect, thiorphan, captopril, tiopronine, and/or N-2-mercapto-propionyl glycine);

(iii) zinc specific chelators; including tetraethylene pentamine and/or 1,10-phenanthroline;

(iv) hypoxanthine, 6-methyl 6-isopropyl chromone, 3-formyl 6-methyl chromone, and/or chloramphenicol;

(v) hydroxamic acids, including, in one aspect, acetohydroxamic, benzohydroxamic, salicylhydroxamic, and/or leucylhydroxamic;

(vi) dipeptide hydroxamic acids, including, in one aspect, hydroxamic acids having a succinyl (dipeptide isostere) motif such as Galardin;

(vii) N-hydroxy urea derivatives, including, in one aspect, dipeptide N-hydroxyl urea derivatives;

(viii) alcohols, carboxyalkylamine peptides, beta-thioester peptides, statins, Batimastat, and/or Marimastat;

(ix) tris(isopropanolamine), hypoxanthine, 3-formyl 6-isopropyl chromone, 3-formyl 6-methyl chromone, beta-ethyl phenethylalcohol, sulfanilic acid, chloramphenicol, and/or cantharidin;

(x) N-phosphoryl leucinamide, and/or bacitracin zinc;

(xi) Carbamic acid, N-[(phenylmethoxy)carbony]N-hydroxy L-Leucinamide (N-CBZ-Leu-NHOH) and/or N-[(phenylmethoxy)carbony]glyclyl-N-hydroxy L-Leucinamide (N-CBZ-Gly-Leu-NHOH); and (xii) Mixtures thereof.

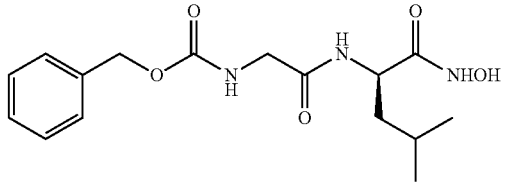

N-CBz-Gly-Leu-NHOH

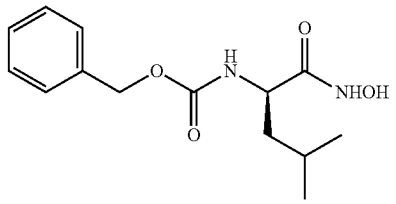

N-CBz-Leu-NHOH

In a further aspect, suitable mass efficient reversible inhibitors can be chosen from those disclosed in EP 0558635 B1 and EP 0558648 B1.

In one aspect, the mass efficient reversible inhibitor may be a hydroxamate derivative, such as galardin, or phosphoramidon or bacitracin zinc. In one aspect the mass efficient reversible inhibitor may be galardin. Commercial sources for such compounds include Sigma Aldrich (Milwaukee, Wis., USA) and Calbiochem (San Diego, Calif., USA). The mono and dipeptide derivatives disclosed herein may be synthesised by the method described in Nishino, Norikazu; Powers, James C., Biochemistry (1978), 17(14), 2846-50.

phosphoramidon

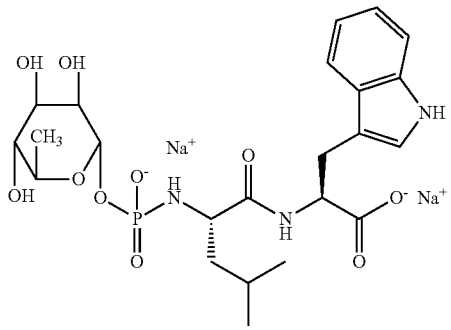

Galardin

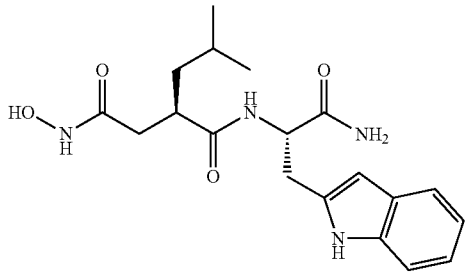

In one aspect, the compositions of the present invention comprise, based on composition weight, from about 0.0001% to about 4%, or from about 0.0002% to about 2%, or from about 0.002% to about 1%, or even from about 0.005% to about 0.5% mass efficient reversible protease inhibitor.

In one aspect, the 4-formyl phenyl boronic acid and the protease enzyme may be present in the compositions of the present invention at a molar ratio of from about 10:1 to about 500:1, or even from about 30:1 to about 200:1.

In one aspect, in compositions of the present invention, the molar ratio of the reversible peptide protease inhibitor to protease enzyme may be from about 1:1 to about 20:1, or even from about 1:1 to about 10:1.

Without wishing to be bound by theory, it is believed that an effective mass efficient reversible protease inhibitor needs to bind tightly to the protease within the formulation, but not so tightly that upon dilution in the wash the protease is not effectively released.

Suitable encapsulated proteases may be prepared by methods such as:

(i) interfacial condensation polymerization, including capsules formed by the reaction of acid chlorides with compounds containing at least two amine groups and polycondensation reaction of formaldehyde with melamine. Examples of such methods are disclosed in U.S. Pat. Nos. 4,906,396, 6,221,829, 6,359,031, 6,242,405 and WO 07/100501 A2.

(ii) sol-gel processes including capsules made by reaction of aminoalkylsilane precursors and aminoalkyl-trialkoxysilane, and one or more alkoxysilane precursors, examples of which are disclosed in WO 05/028603 A1 and WO 05/028604 A1; and (iii) polyectrolyte precipitation, including capsules formed by reaction of chitosan and alginate or using biopolymer gels such as gellan. Examples of such methods are disclosed in EP 1,502,645 A1.

In one aspect the encapsulated protease may comprise at least 0.5%, or at least 1%, or at least 2%, or at least 5%, or at least 10%, or even at least 20% by weight active protease enzyme.

In one aspect, encapsulated proteases may comprise from about 5% to about 90% active protease by weight.

Encapsulated proteases may be incorporated into the compositions of the present invention, based on total composition weight, at a level of from 0.001% to about 30%, or from about 0.005% to about 25%, or from about 0.05% to about 10% or even from about 0.01% to about 2%.

When said encapsulated proteases are in the form of enzyme microcapsules, said microcapsules typically have a particle size of from about 100 microns to about 0.05 microns, from about 80 microns to about 0.05 microns, or even from about 50 microns to about 0.05 microns. Thus, in one aspect, such microcapsules are sized such that they are not typically visible to a consumer when such microcapsules are incorporated into a cleaning composition.

In one aspect, the encapsulated protease releases at least 80% of its protease load within 10 minutes, within 5 minutes, or even within 2 minutes upon dilution in the wash. In one aspect, these release rates are achievable at ambient temperatures under a 100 fold dilution at 20° C. with stirring at 150 rpm. Protease activity can be determined by any standard method such as use of protease analysis kits available from Sigma Aldrich, Milwaukee, Wis., USA or ASTM method D0348-89 (2003). Without wishing to be bound by theory, it is believed that a better cleaning profile is obtained as the time that the enzymes have to interact with the soil is increased.

In one aspect, encapsulated proteases may be enzyme granulates/prills, having an average particle size of 200-1000 microns. Such enzyme granules/prills may be made in accordance with the teachings of U.S. Pat. Nos. 4,106,991, 4,242,219, 4,689,297, 5,324,649 and 7,018,821 B2. In one aspect, such enzyme granulates/prills may comprise a dye and/or pigment. In one aspect, such enzyme granulates/prills may comprise a coating comprising hydroxpropylmethylcellulose and/or polyvinylalcohol and derivatives thereof.

Bleach Activator

Preferably, the composition comprises a bleach activator. Suitable bleach activators are compounds which when used in conjunction with a hydrogen peroxide source leads to the in situ production of the peracid corresponding to the bleach activator. Various non limiting examples of bleach activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetylethylenediamine (TAED) activators are typical, and mixtures thereof can also be used. See also U.S. Pat. No. 4,634,551 for other typical bleaches and activators useful herein. Another suitable bleach activator is decanoyloxybenzenecarboxylic acid (DOBA).

Highly preferred amido-derived bleach activators are those of the formulae:

$$R^1N(R^5)C(O)R^2C(O)L \text{ or } R^1C(O)N(R^5)R^2C(O)L$$

wherein as used for these compounds $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the hydroperoxide anion. A preferred leaving group is oxybenzenesulfonate.

Preferred examples of bleach activators of the above formulae include (6-octanamidocaproyl)oxybenzenesulfonate, (6-nonanamidocaproyl)oxybenzenesulfonate, (6-decanamidocaproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

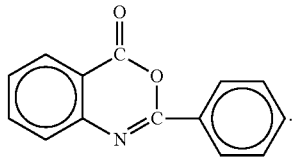

Still another class of preferred bleach activators includes the acyl lactam activators, especially acyl caprolactams and acyl valerolactams of the formulae:

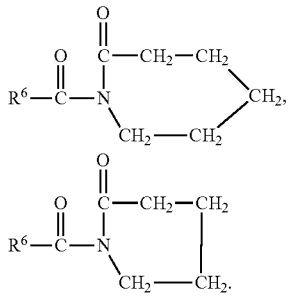

wherein as used for these compounds $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate. Highly preferred bleach activators are nonanoyloxybenzene sulfonate (NOBS) and/or tetraacetylethylenediamine (TAED).

It is highly preferred for a large amount of bleach activator relative to the source of hydrogen peroxide to be present in the laundry detergent composition. Preferably, the weight ratio of bleach activator to source of hydrogen peroxide present in the laundry detergent composition is at least 0.5:1, at least 0.6:1, at least 0.7:1, 0.8:1, preferably at least 0.9:1, or 1.0:1.0, or even 1.2:1 or higher.

Chelant

The composition may comprise a chelant. Suitable chelants include diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). A preferred chelant is ethylene diamine-N'N'-disuccinic acid (EDDS) and/or hydroxyethane diphosphonic acid (HEDP). Preferably the ethylene diamine-N'N'-disuccinic acid is in S'S' enantiomeric form.

Other Detergent Ingredients

The composition typically comprises other detergent ingredients. Suitable detergent ingredients include: transition metal catalysts; enzymes such as amylases, carbohydrases, cellulases, laccases, lipases, bleaching enzymes such as oxidases and peroxidases, proteases, pectate lyases and mannanases; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters; perfumes such as perfume microcapsules; soap rings; aesthetic particles; dyes; fillers such as sodium sulphate, although it is preferred for the composition to be substantially free of fillers; silicate salt such as sodium silicate, including 1.6 R and 2.0 R sodium silicate, or sodium metasilicate; co-polyesters of di-carboxylic acids and diols; cellulosic polymers such as methyl cellulose, carboxymethyl cellulose, hydroxyethoxycellulose, or other alkyl or alkylalkoxy cellulose; and any combination thereof.

Reserve Alkalinity

As used herein, the term "reserve alkalinity" is a measure of the buffering capacity of the laundry detergent composition (g/NaOH/100 g detergent composition) determined by titrating a 1% (w/v) solution of detergent composition with hydrochloric acid to pH 7.5 i.e in order to calculate Reserve Alkalinity as defined herein:

$$\text{Reserve Alkalinity (to pH 7.5) as } \%\ alkali \text{ in g NaOH/100 g product} = \frac{T \times M \times 40 \times Vol}{10 \times Wt \times Aliquot}$$

$T$ = *titre* (ml) to pH 7.5

$M$ = Molarity of HCl = 0.2

40 = Molecular weight of NaOH

-continued $Vol$ = Total volume (ie. 1000 ml)

$W$ = Weight of product (10 g)

$Aliquot$ = (100 ml)

Obtain a 10 g sample accurately weighed to two decimal places, of fully formulated detergent composition. The sample should be obtained using a Pascall sampler in a dust cabinet. Add the 10 g sample to a plastic beaker and add 200 ml of carbon dioxide-free de-ionised water. Agitate using a magnetic stirrer on a stirring plate at 150 rpm until fully dissolved and for at least 15 minutes. Transfer the contents of the beaker to a 1 liter volumetric flask and make up to 1 liter with deionised water. Mix well and take a 100 mls±1 ml aliquot using a 100 mls pipette immediately. Measure and record the pH and temperature of the sample using a pH meter capable of reading to ±0.01pH units, with stirring, ensuring temperature is 21° C.+/−2° C. Titrate whilst stirring with 0.2M hydrochloric acid until pH measures exactly 7.5. Note the milliliters of hydrochloric acid used. Take the average titre of three identical repeats. Carry out the calculation described above to calculate the reserve alkalinity to pH 7.5.

Preferably, the composition has a reserve alkalinity of 10.0 or less, or 9.0 or less, or 8.0 or less, or 7.0 or less, or 6.0 or less, or 5.0 or less, or 4.0 or less, or 3.0 or less, or 2.0 or less, or 1.0 or less.

Method to Determine the Reduction in Activation Energy

For the purpose of the present invention, when calculating the reduction in activation energy achieved by a catalyst, the uncatalysed reaction is considered to have an activation energy of 50 $kjmol^{-1}$.

The assays used to determine the rate of reaction and associated activation energies are all conducted under high excess of substrate. For enzyme catalysts under such conditions, the kinetics of production of the digested products is approximately first order. For non-enzyme catalysts the assays must also be carried out under conditions that have first order kinetics. All assays should be conducted over a period of time t such that the kinetics remain first order (i.e. such that concentration of product is low (and always less than 10% of theoretical maximum) and first order kinetics are obeyed). The rate constant k can therefore be calculated by plotting a graph of In c against t, wherein c is the concentration of products produced and t is the time in seconds. These graphs are linear and the gradients of the graphs are the rate constants k whose units are $s^{-1}$.

A series of such graphs are plotted to determine the rate constants at various temperatures under which the enzyme assays are conducted.

These systems follow Arrhenius behaviour (i.e. $k=A\,e^{-Ea/RT}$), so a plot of In k versus 1/T gives a straight line whose gradient is −Ea/R, where Ea is the activation energy in $Jmol^{-1}$, A is the pre-exponential factor, T is the temperature in Kelvin and R is the universal gas constant which, for the purpose of the present invention, is 8.314 $Jmol^{-1}K^{-1}$.

For enzymes in general (except for assays on oxidoreductase enzymes), the optimal way to determine enzyme activity in a detergent sample is to make up a 1% w/v detergent composition in an aqueous solution of sodium thiosulphate and calcium chloride (10 g of sodium thiosulphate and 0.5 g of $CaCl_2.2H_2O$ dissolved in 1 liter of water) and react this solution with an appropriate solution comprising the substrate dissolved in TRIS buffer at pH 8.3 (12.1 g of tris (hydroxymethyl) aminomethane (e.g. sold under tradename Trizma™) in one liter of water, adjusted to pH with concentrated HCl and/or NaOH) and monitor product formation through time. Most enzyme assays are done colorimetrically such that product formation can be monitored spectrophotometrically. In all cases care must be taken to ensure that the absorbance is less than 2 absorbance units such that the absorbance measurement is directly proportional to the concentration of coloured product being formed. The assay is conducted at a series of temperatures at which the enzyme displays suitable activity but is not denatured and in the presence of a high excess of substrate.

For non-enzyme catalysts, a similar procedure to that described above may also be used. For example, a 1% w/v detergent composition in a solution is reacted with a suitable colorimetric substrate under conditions of first order kinetics, and for at least three different temperatures. For imine bleach catalysts, a suitable colorimetric substrate is CI reactive blue 49 dye (e.g. CAS 12236-92-9). For transition metal catalysts a suitable colorimetric substrate is beta-Apo-8-carotenal (otherwise known as canthaxanthin).

Suitable assays for some of the catalysts are described in more detail below. In the assays below, any percentage concentration value is considered to be % w/v, unless otherwise indicated.

Assay for Enzymes from E.C. 3.1.1.3 (Triacylglycerol Lipase) (Herein: "Lipase Assay")

The activity of lipase is assayed by measuring the hydrolysis rate of para-nitrophenol palmitate (PNP-palmitate). The lipase cleaves the ester bond releasing the coloured species (paranitrophenol) which can be measured by absorbance at 405 nm.

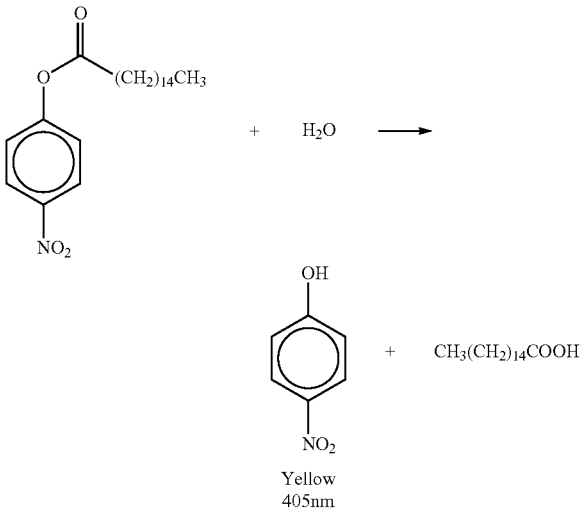

A one liter TRIS buffer solution is first made by dissolution of 12.1 g of Trizma™ base, 2.70 g of sodium deoxycholate and 5.0 g alpha olephin sulphonate (e.g. Bio Terge AS-90 Beads, lot #24242404) in a liter of water and adjusting pH to 8.3 by addition of concentrated HCl. A PNP-palmitate solution is then made by dissolving 0.15 g of PNP-palmitate in 50 ml of ethanol. 2 ml of the PNP-palmitate solution is then dissolved in 48 ml of a TRIS buffer solution to provide 50 mls of the PNP-palmitate substrate working solution.

An enzyme stabilizing solution is made up by dissolving 10 g of sodium thiosulphate and 0.5 g of $CaCl_2.2H_2O$ in 1 liter of water. 10 g of the detergent product are dissolved in this solution to make one liter of solution (a 1% detergent solution).

40 μl of the 1% detergent solution and 250 μl of the PNP-palmitate substrate working solution are mixed and incubated at the chosen temperature. At a given time t, the absorbance is read at 405 nm. The substrate (PNP-palmitate) is present in high excess and the reaction rate monitored over a 110 second period such that the kinetics of product formation are approximately first order. A plot of ln c (where c is the concentration of products formed) versus t (time in seconds) is approximately linear. The above assay is conducted at three different temperatures (20° C., 25° C. and 30° C.) and in that way a rate constant k (whose units are $s^{-1}$) is assayed at each temperature.

A linear graph is then plotted of ln k against −1000/RT whose gradient is equal to the activation energy in $kJmol^{-1}$.

Assay for Enzymes from E.C. 3.4.x.x (Peptidases) (Herein: "Protease Assay")

The activity of the protease is assayed using standard analytical methods. The substrate used to measure the protease activity for subtilisins is a four amino acid peptide containing a terminal p-nitroanilide group as a chromophore. This material is called N-Succinyl-ALA-ALA-PRO-PHE p-nitroanilide (PNA). A solution of protease is introduced to the PNA substrate in solution. The enzyme cleaves bonds between amino acids and most importantly the amide bond between the phenolalanine and the p-nitroanilide group liberating p-nitroaniline, thus producing a yellow color. The intensity of the color (405 nm) is proportional to the amount of enzyme in the solution.

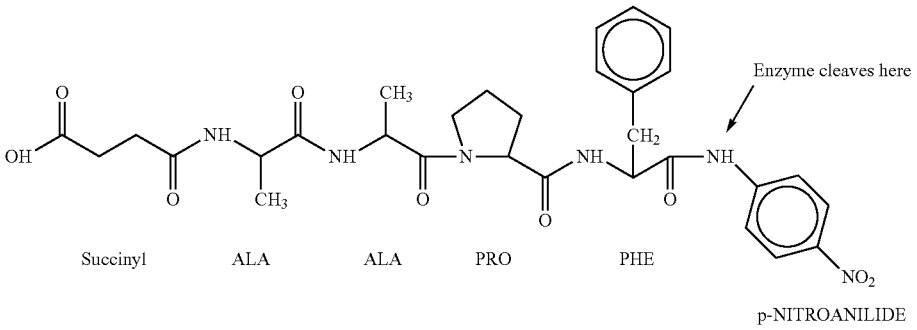

A one liter TRIS buffer solution is first made by dissolution of 12.1 g of Trizma™ base, 1.1 g of $CaCl_2.2H_2O$ and 5.0 g of sodium thiosulphate in a liter of water and adjusting pH to 8.3 by addition of concentrated HCl and/or NaOH. A PNA solution is then made by dissolving 0.5 g of N-Succinyl-ALA-ALA-PRO-PHE p-nitroanilide (PNA) in 5 ml of DMSO. 0.5 ml of the PNA solution is then dissolved in 50 ml of a TRIS buffer solution to provide the PNA substrate working solution.

An enzyme stabilizing solution is made up by dissolving 10 g of sodium thiosulphate and 0.5 g of $CaCl_2.2H_2O$ in 1 liter of water. 10 g of the detergent product are dissolved in this solution to make one liter of solution (a 1% w/v detergent solution).

7 μl of the 1% w/v detergent solution and 245 μl of the PNA substrate working solution are mixed and incubated at the chosen temperature (e.g. 30° C., 37° C. and 50° C., respectively). At a given time t, the absorbance is read at 405 nm.

A plot of ln c (where c is the concentration of products formed) versus t (time in seconds) is linear. The above assay is conducted at three different temperatures (30° C., 37° C. and 50° C.) and at least three time points such that a rate constant k (whose units are $s^{-1}$) is assayed at each temperature.

A graph is then plotted of ln k against −1000/RT whose gradient is equal to the activation energy in $kJmol^{-1}$.

Assay for Enzymes from E.C. 3.2.1.1 (α-amylase) (Herein: "Alpha-amylase Assay")

Amylase activity is measured using a maltoheptaoside modified with a p-Nitrophenol chromophore (Infinity Amylase Reagent from Thermo Electron, Woburn, Mass., USA, Cat #: TR25421). Release of the chromophore is initiated via amylase action. Amylase activity is measured initially in AMU's. 1 AMU (amylase unit) is the amount of enzyme which hydrolyzes PNP-G7 (p-nitrophenyl-alpha,D-maltoheptaoside) carbohydrate substrate such that the initial rate of formation of small carbohydrates (G2-4) per minute corresponds to 1 μmole of 4-Nitrophenol per minute.

A one liter TRIS buffer solution is first made by dissolution of 12.1 g of Trizma™ base, 2.70 g of sodium deoxycholate and 5.0 g alpha olephin sulphonate (e.g. Bio Terge AS-90 Beads, lot #24242404) in a liter of water and adjusting pH to 8.3 by addition of concentrated HCl and/or NaOH. A PNP-palmitate solution is then made by dissolving 0.15 g of PNP-palmitate in 50 ml of ethanol. 2 ml of the PNP-palmitate solution is then dissolved in 48 ml of a TRIS buffer solution to provide 50 mls of the PNP-palmitate substrate working solution.

An enzyme stabilizing solution is made up by dissolving 10 g of sodium thiosulphate and 0.5 g of $CaCl_2.2H_2O$ in 1 liter of water. 10 g of the detergent product are dissolved in this solution to make one liter of solution (a 1% w/v detergent solution).

30 μl of 1% w/v detergent solution is added to 230 μl of Infinity amylase reagent. The samples are mixed and incubated at a series of temperatures and activity monitored through time. The absorbance is read at 405 nm and this is proportional to the concentration of reaction products formed.

A plot of ln c (where c is the concentration of products formed) versus t (time in seconds) is linear. The above assay is conducted at three different temperatures (20° C., 30° C. and 37° C.) and at least three time points such that a rate constant k (whose units are $s^{-1}$) is assayed at each temperature.

A graph is then plotted of ln k against −1000/RT whose gradient is equal to the activation energy in $kJmol^{-1}$.

Assay for Enzymes from E.C. 3.2.1.151 (Xyloglucan-specific Endo-β-1,4-glucanase)

A suitable colourmetric substrate for determining xyloglucanase activity is AZCL-xyloglucan from Megazyme, Ireland. Enzyme activity is determined at three different temperatures using suitable time periods and the activation energy is determined using the above described calculation.

Assay for Enzymes from E.C. 3.2.1.4 (Cellulase), E.C. 3.2.1.21 (β-glucosidase) and E.C. 3.2.1.91 (Cellulose 1,4-β-cellobiosidase) (Herein: "Cellulase Assay")

A suitable colourmetric substrate for determining cellulase activity is Cellazyme C tablets, supplied by Megazyme International Ireland. Enzyme activity is determined at three different temperatures using suitable time periods and the activation energy is determined using the above described calculation.

Assay for Enzymes from E.C. 1.1.3.x (Oxidoreductases Acting on CH—OH as Donor and with Oxygen as Acceptor)

The activity and activation energy of glucose oxidase-catalysed oxidation of D-glucose with concomitant formation of hydrogen peroxide can be determined using the methods described in Zia M. A et al., Thermal characterization of purified glucose oxidase from a newly isolated *Aspergillus niger* UAF-1, (2007) Journal of Clinical Biochemistry and Nutrition, 41 (2), pp. 132-138. Similar procedures can be used for the other oxidoreductases.

Assay for Imine Bleach Catalyst

The substrate used is Reactive Blue 49 dye, and the assay is colorimetric titration. The principle of the assay is that Reactive Blue 49 dye is added to a 1% detergent aqueous solution to give a 20 ppm Reactive Blue 49 dye concentration. The imine bleach catalyst catalyzes a reaction that decolourizes the dye, causing a reduction in the optical density of the solution. In this assay, additional Reactive Blue 49 dye is titred into the reaction solution in order to compensate for the decolourization kinetics and to maintain a constant optical density. This amount of compensating Reactive Blue 49 dye is measured over a time period of five minutes. Performing the reaction at different temperatures allows calculation of Activation energy using Arrhenius equation The following is repeated at four different temperatures: e.g. 20° C., 25° C., 35° C. and 45° C. 8 g of detergent composition is dissolved in 800 ml of deionised water. A 100 ml aliquot is filtered through a GFC filter, Whatman™. 80 mls of this solution is added to a titration vessel sitting on a hotplate stirrer set at the desired temperature. 2.5 mls of a 733 ppm Reactive Blue 49 dye solution is added and the titrator method is initiated. A Mettler titrator (model DL55) fitted with a DP5 phototrode set at 590 nm adjusts the optical density of the solution to give a constant phototrode output of 500 mV over a 5 minute period. The titre result in micromoles of reactive blue solution consumed per second is recorded. Repeat the above at each temperature. Then plot ln k vs 1/T (in Kelvin) to obtain a graph the slope of which is the −activation energy/R (R=universal gas constant).

EXAMPLES

| Ingredient | Composition A | Composition B | Composition C | Composition D |
|---|---|---|---|---|
| Imine bleach catalyst* | 0.05 wt % | 0.1 wt % | 0.05 wt % | 0.01 wt % |
| Transition metal bleach catalyst** | 0.05 wt % | 0.05 wt % | 0.1 wt % | 0.01 wt % |
| Protease Purafect ™ | 0.1 wt % | 0.1 wt % | 0.1 wt % | 0.1 wt % |
| Cellulase (Celluclean ™) | 0.1 wt % | 0.1 wt % | 0.1 wt % | 0.1 wt % |
| Mannanase (Mannaway ™) | 0.1 wt % | 0.1 wt % | 0.1 wt % | 0.1 wt % |
| Pectate lyase (Pectaway ™) | 0.1 wt % | 0.1 wt % | 0.1 wt % | 0.1 wt % |
| Alpha-amylase (Stainzyme Plus ™) | 0.1 wt % | 0.1 wt % | 0.1 wt % | 0.1 wt % |
| Lipase (Lipex ™) | 0.1 wt % | 0.1 wt % | 0.1 wt % | 0.1 wt % |
| Cutinase*** | 0.1 wt % | 0.1 wt % | 0.1 wt % | 0.1 wt % |
| Peroxidase (Guardzyme ™) | 0.1 wt % | 0.1 wt % | 0.1 wt % | 0.1 wt % |
| Feruloyl esterase**** | 0.1 wt % | 0.1 wt % | 0.1 wt % | 0.1 wt % |
| OxyGo 1500 ™ | 0.1 wt % | 0.1 wt % | 0.1 wt % | 0.1 wt % |
| Tetraacetylethylenediamine (TAED) | 5.0 wt % | 6 wt % | 10 wt % | 5 wt % |
| Sodium percarbonate (PC3) | 5.0 wt % | 10 wt % | 5 wt % | 7 wt % |
| hydroxyethane di[methylene phosphonic acid] (HEDP) | 0.5 wt % | 0.5 wt % | 0.1 wt % | 0.5 wt % |
| $C_{11-13}$ alkyl benzene sulphonate (LAS) | 25.0 wt % | 25 wt % | 20 wt % | 20 wt % |
| Ethoxylated $C_{12-15}$ alkyl sulphate having average degree of ethoxylation of between 1 and 3 ($AE_{1-3}S$) | 10.0 wt % | 7 wt % | 15 wt % | 10 wt % |
| mono-$C_{8-10}$ alkyl mono-hydroxyethyl di-methyl quaternary ammonium chloride | 3.0 wt % | 3.0 wt % | 2.5 wt % | 3.0 wt % |
| Sodium sulphate | 3.0 wt % | 0 wt % | 0 wt % | 1 wt % |
| Sodium carbonate | 10.0 wt % | 12 wt % | 10 wt % | 8 wt % |
| Sodium silicate (1.6R) | 10.0 wt % | 5 wt % | 5 wt % | 10.0 wt % |
| Zeolite 4A | 4.0 wt % | 3 wt % | 3 wt % | 5.0 wt % |
| Florescent whitening agent | 0.5 wt % | 0.5 wt % | 0.1 wt % | 0.5 wt % |
| Silicone suds suppressor | 0.05 wt % | 0.05 wt % | 0.1 wt % | 0.05 wt % |
| Co-polymer of maleic acid and acrylic acid (MA/AA) | 5.0 wt % | 10 wt % | 12 wt % | 10 wt % |
| Polyethylene oxide with pendant polyvinylacetate groups | 2.0 wt % | 4.0 wt % | 1.0 wt % | 1.5 wt % |
| Carboxymethyl cellulose (CMC) | 5.0 wt % | 4.0 wt % | 3.0 wt % | 4.0 wt % |
| Repel-o-tex | 0 wt % | 0 wt % | 1.0 wt % | 2.0 wt % |
| Moisture & Miscellaneous | To 100 wt % | to 100 wt % | to 100 wt % | to 100 wt % |

*Imine bleach catalyst is sulphuric acid mono-[2-(3,4-dihydro-isoquinolin-2-yl)-1-(2-butyl-octyloxymethyl)-ethyl] ester, internal salt.
**Transition metal bleach catalyst is Dichloro-5,12-diethyl-1,5,8,12-tetraazabicyclo[6.6.2]hexadecanemanganese
***Cutinase is a variant of the wild-type derived from *Pseudomonas Mendocina* comprising the F180P & S205G mutations as described in WO 03/076580.
****Feruloyl esterase is Depol 740LTM supplied from Biocatalysts, UK.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention

What is claimed is:

1. A solid laundry detergent composition consisting of eight catalysts, 0-10 wt % sodium carbonate, 0-10 wt % zeolite builder, 0-10 wt % phosphate builder, 0-10 wt % sodium sulphate, 0-10 wt % silicate, 0-10 wt % sodium chloride and less than 40 wt % reducing sugar, wherein the eight catalysts are a protease, an amylase, a cellulase, a lipase, a mannose, a pectate lyase, a manganese centered catalyst, and a cobalt centered catalyst, and wherein the ratio of (i) the total reduction in activation energy in kilojules per mole achieved by the catalysts to (ii) the electrolytic strength of the laundry detergent composition as a concentration of 1 g/L in deionized water and at a temperature of 25 degrees C. in mScm-1 is at least 300.

2. A laundry detergent composition according to claim 1, wherein the ratio of (i) the total reduction in activation energy in kilojoules per mole achieved by the catalysts to (ii) the electrolytic strength of the laundry detergent in mScm-1 is at least 1000.

3. A laundry detergent composition according to claim 1, wherein the catalyst reduces the activation energy by a total of at least 160 $kjmol^{-1}$.

4. A laundry detergent composition according to claim 1, wherein the composition is in free-flowing particulate form.

5. A method of laundering fabric in an automatic washing machine, comprising the step of contacting a laundry detergent composition according to claim 1, to water to form a wash liquor, and laundering fabric in said wash liquor, wherein 30 g or less of the laundry detergent is added to the water.

* * * * *